US008038107B1

(12) United States Patent
Goins

(10) Patent No.: US 8,038,107 B1
(45) Date of Patent: Oct. 18, 2011

(54) METHOD OF RETAINING A LAWN WASTE BAG IN AN OPEN POSITION

(76) Inventor: Jarvis T. Goins, Merrilville, IN (US)

( * ) Notice: Subject to any disclaimer, the term of this patent is extended or adjusted under 35 U.S.C. 154(b) by 302 days.

(21) Appl. No.: 12/274,533

(22) Filed: Nov. 20, 2008

(51) Int. Cl.
*A63B 55/04* (2006.01)
*B65B 67/04* (2006.01)

(52) U.S. Cl. ..... 248/97; 248/99; 248/439

(58) Field of Classification Search ..... 248/95, 248/97, 99, 150, 168, 188.5, 439, 464, 465, 248/907; 141/390, 391
See application file for complete search history.

(56) References Cited

U.S. PATENT DOCUMENTS 2,731,184 A * 1/1956 Thurber, Jr. ..... 141/390
3,638,888 A 2/1972 Ross
3,893,648 A 7/1975 Gilbert
4,537,376 A * 8/1985 Buku ..... 248/97
4,562,983 A * 1/1986 Klefbeck ..... 248/97
4,667,912 A 5/1987 DeVilbiss
4,783,031 A * 11/1988 Ebentheuer ..... 248/97
D308,271 S 5/1990 Vreeken
5,183,226 A 2/1993 Brooks
5,222,536 A * 6/1993 Hodgdon et al. ..... 141/390
5,868,364 A * 2/1999 MacMillan ..... 248/97
5,924,657 A 7/1999 Bach
6,511,026 B2 * 1/2003 Hatfield ..... 248/97
7,066,432 B2 * 6/2006 Wood et al. ..... 248/99

* cited by examiner

*Primary Examiner* — Tan Le

(57) ABSTRACT

A method of retaining a lawn waste bag in an open position for includes providing a yard waste bag having a bottom wall and a perimeter wall attached to and extending upwardly from the bottom wall. The perimeter wall has an upper edge defining an opening into an interior of the yard waste bag. A frame is provided as well as a plurality of legs each having has a top end and a bottom end. Each of the legs is pivotally coupled to the frame by one of the couplers. The yard waste bag is opened and the legs are extended into the yard waste bag and to abut the bottom ends against the bottom wall to retain the yard waste bag in an open configuration.

2 Claims, 5 Drawing Sheets

METHOD OF RETAINING A LAWN WASTE BAG IN AN OPEN POSITION

BACKGROUND OF THE INVENTION

Field of the Invention

The present invention relates to bag holding devices and more particularly pertains to a new bag holding device for retaining a yard waste bag in an open configuration so that it may more easily be filled with yard waste.

SUMMARY OF THE INVENTION

The present invention meets the needs presented above by generally providing a yard waste bag having a bottom wall and a perimeter wall attached to and extending upwardly from the bottom wall. The perimeter wall has an upper edge defining an opening into an interior of the yard waste bag. A frame is provided as well as a plurality of legs each having has a top end and a bottom end. Each of the legs is pivotally coupled to the frame by one of the couplers. The yard waste bag is opened and the legs are extended into the yard waste bag and to abut the bottom ends against the bottom wall to retain the yard waste bag in an open configuration.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
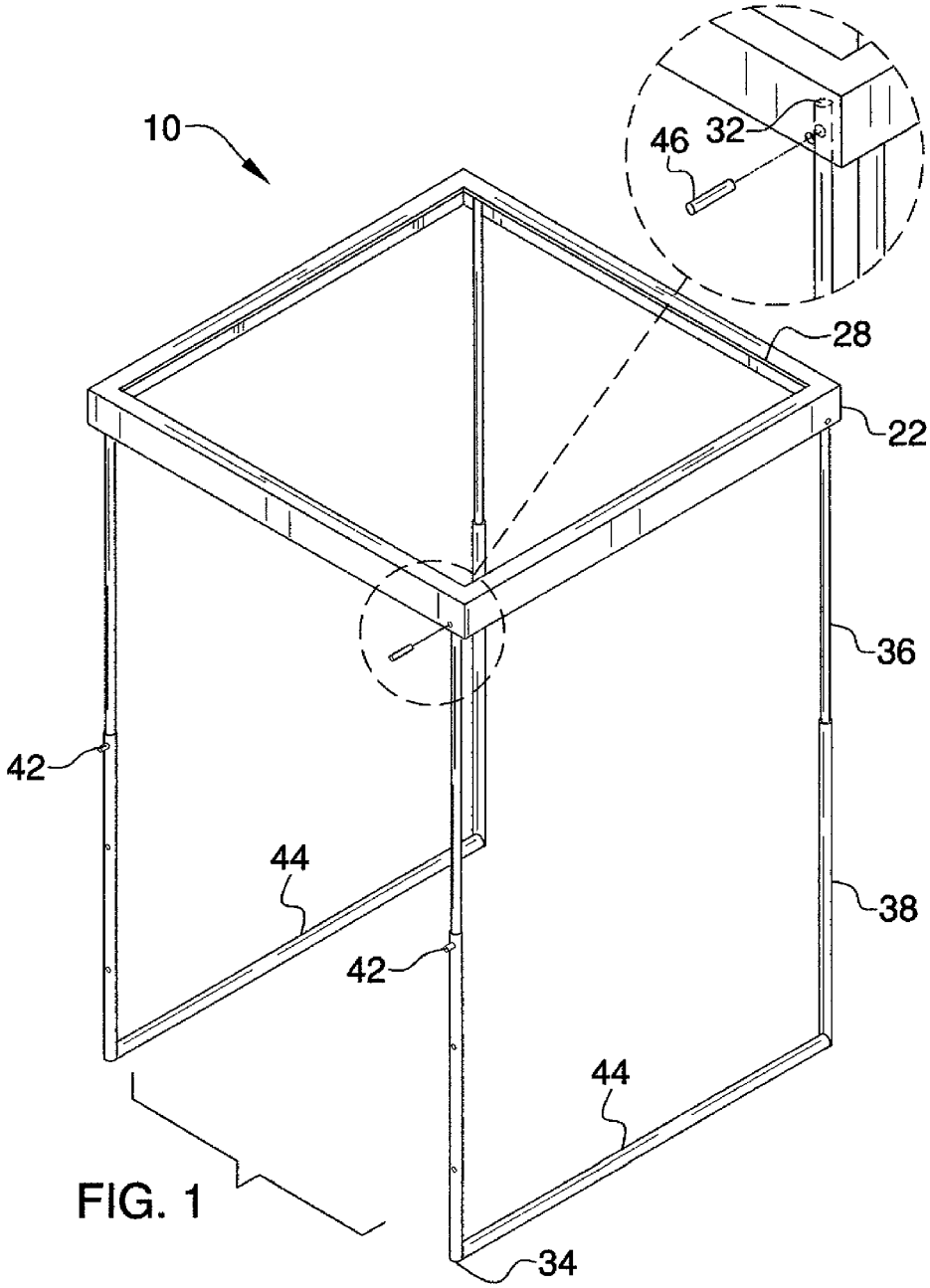
FIG. 1 is a perspective view of an apparatus for a method of retaining a lawn waste bag in an open position according to the present invention.
Figure 2:
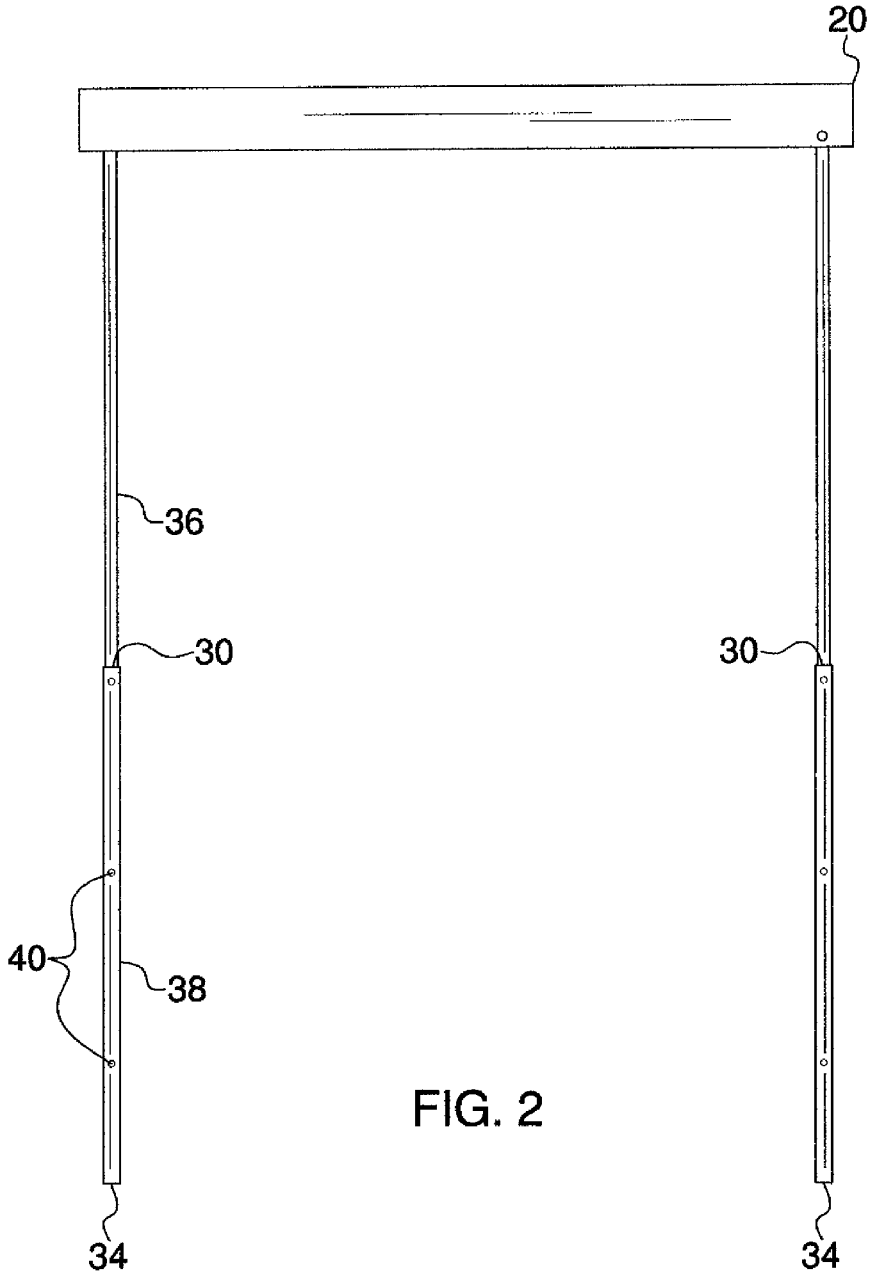
FIG. 2 is a side view of the present invention.
Figure 3:
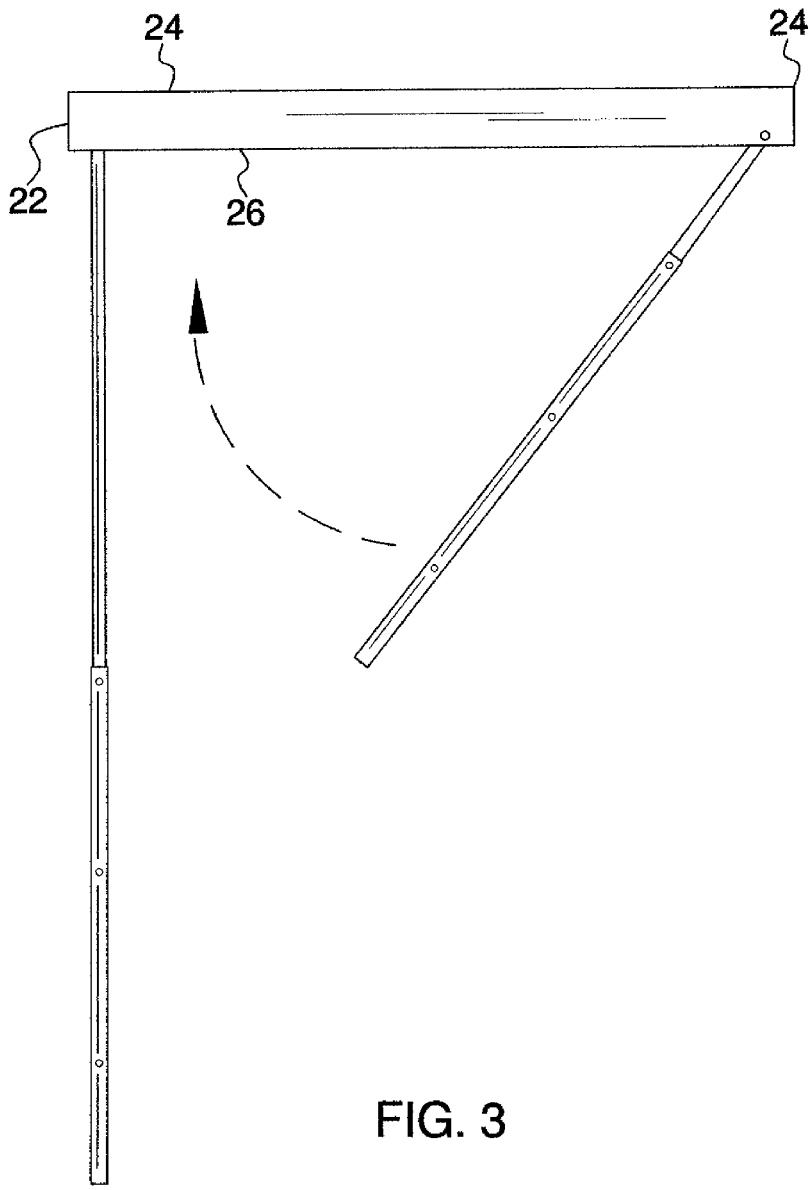
FIG. 3 is a side view of the present invention.
Figure 4:
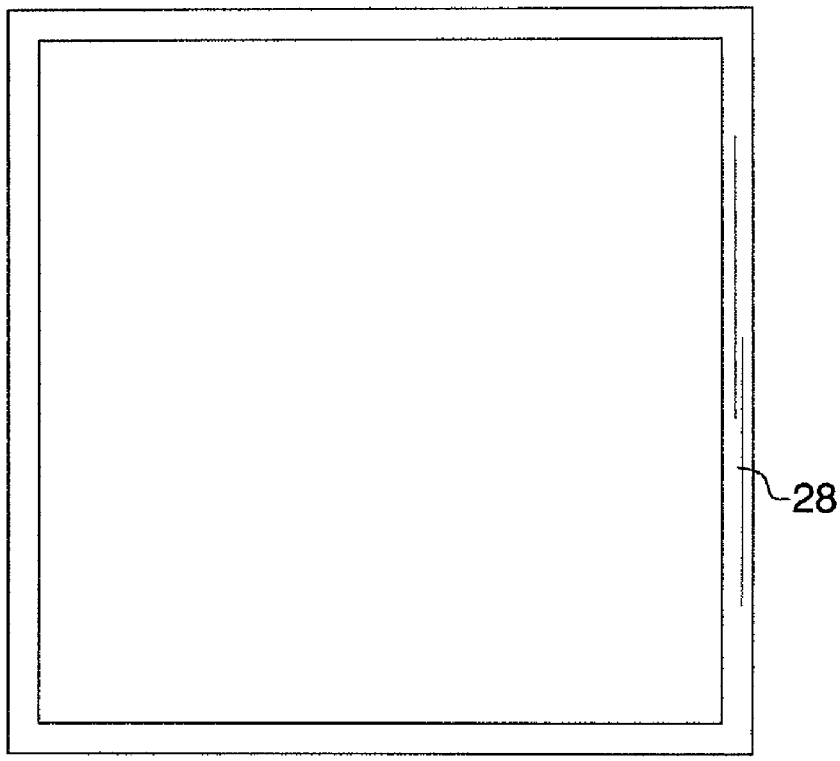
FIG. 4 is a top view of the present invention.
Figure 5:
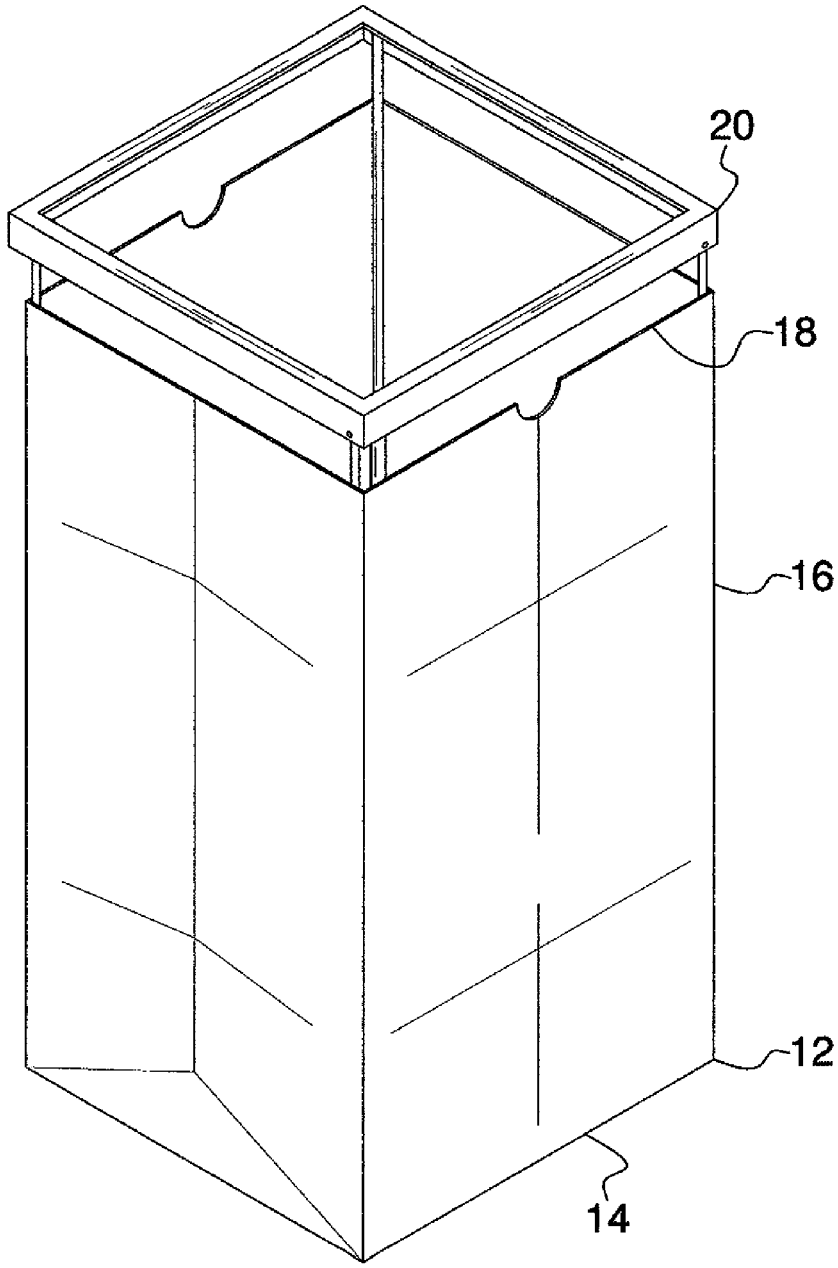
FIG. 5 is a perspective in-use view of the present invention.

With reference now to the drawings, and in particular to FIGS. 1 through 5 thereof, a new bag holding device embodying the principles and concepts of the present invention and generally designated by the reference numeral 10 will be described.

As best illustrated in FIGS. 1 through 5, the method of retaining a lawn waste bag in an open position and apparatus 10 therefore generally comprises providing a yard waste bag 12 that has a bottom wall 14 and a perimeter wall 16 that is attached to and extends upwardly from the bottom wall 14. The perimeter wall 16 has an upper edge 18 defining an opening into an interior of the yard waste bag 12.

A frame 20 includes a perimeter wall 22 has a top edge 24 and a bottom edge 26. The perimeter wall 22 has a rectangular configuration. A perimeter flange 28 is attached to the top edge and extends inward of the frame 20. The frame 20 has a length between 11 inches and 14 inches and a length between 14 inches and 17 inches.

A plurality of legs 30 is provided. Each of the legs 30 has a top end 32 and a bottom end 34. Each of the legs 30 is telescopic and has an adjustable height. The legs 30 each include a first section 36 slidably extendable into a second section 38. The second sections 38 each include a plurality of apertures 40 to receive an outwardly biased detent 42 mounted in corresponding ones of the first sections 36. When fully extended, the legs 30 may have a height between 30 inches and 50 inches. A pair of stabilizers 44 is used to stabilize the legs 30 with respect to each other. Each of the stabilizers 44 is attached to and extends between a pair of legs 30 adjacent to an associated one of the bottom ends 34 so that two pairs of legs 30 are defined each including one of the stabilizers 44.

A plurality of couplers 46 is provided. Each of the legs 30 is pivotally coupled to the frame 20 by one of the couplers 46. The couplers comprise a pin removably extended into the perimeter wall 22 and extended into one of the legs 30 adjacent to an associated one of the top ends 32.

In use, the yard waste bag 12 is opened and the legs 30 are adjusted to have a height at least equal to a height of the yard waste bag 12. The legs 30 are then extended into the yard waste bag 12 and the bottom ends 34 abutted against the bottom wall 14 to retain the yard waste bag 12 in an open configuration. The yard waste bag 12 may then be filled with yard waste and the apparatus 10 removed from the yard waste bag 12 when finished.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A method of retaining a bag in an open configuration comprising the steps of:

providing a yard waste bag having a bottom wall and a perimeter wall being attached to and extending upwardly from said bottom wall, said perimeter wall having an upper edge defining an opening into an interior of said yard waste bag;

providing a frame, said frame including a perimeter wall having a top edge and a bottom edge, said perimeter wall having a rectangular configuration, a perimeter flange being attached to said top edge and extending inward of said frame;

providing a plurality of legs, each of said legs having a top end and a bottom end, each of said legs being telescopic and having an adjustable height;

providing a plurality of couplers, each of said legs being pivotally coupled to said frame by one of said couplers, each of said couplers comprising a pin removably extended into said perimeter wall and extended into one of said legs adjacent to an associated one of said top ends;

providing a pair of stabilizers, each of said stabilizers being attached to and extending between a pair of legs adjacent to an associated one of said bottom ends so that two pairs of legs is defined each including one of said stabilizers;

opening said yard waste bag;

adjusting said legs to have a height at least equal to a height of said yard waste bag; and extending said legs into said yard waste bag and abutting said bottom ends against said bottom wall to retain said yard waste bag in an open configuration.

2. A bag retention apparatus positionable in a yard waste bag to retain the yard waste bag in an open configuration, said apparatus comprising:

a frame, said frame including a perimeter wall having a top edge and a bottom edge, said perimeter wall having a rectangular configuration, a perimeter flange being attached to said top edge and extending inward of said frame;

a plurality of legs, each of said legs having a top end and a bottom end, each of said legs being telescopic and having an adjustable height;

a plurality of couplers, each of said legs being pivotally coupled to said frame by one of said couplers;

a pair of stabilizers, each of said stabilizers being attached to and extending between a pair of legs adjacent to an associated one of said bottom ends so that two airs of legs is defined each including one of said stabilizers; and wherein said legs are extendable into the yard waste bag and said bottom ends abuttable against a bottom wall of the yard waste bag to retain the yard waste bag in an open configuration.

* * * * *